US006485353B1

(12) United States Patent
Laycock et al.

(10) Patent No.: US 6,485,353 B1
(45) Date of Patent: Nov. 26, 2002

(54) APPARATUS AND METHOD FOR GRINDING COMPOSITE WORKPIECES

(75) Inventors: Michael Laycock, Keighley (GB); Ian David Locker, Ilkley (GB)

(73) Assignee: UNOVA U.K. Limited, Aylesbury (GB)

( * ) Notice: Subject to any disclaimer, the term of this patent is extended or adjusted under 35 U.S.C. 154(b) by 0 days.

(21) Appl. No.: 09/720,109

(22) PCT Filed: Jul. 16, 1999

(86) PCT No.: PCT/GB99/01906

§ 371 (c)(1),
(2), (4) Date: Feb. 20, 2001

(87) PCT Pub. No.: WO99/67055

PCT Pub. Date: Dec. 29, 1999

(30) Foreign Application Priority Data

Jun. 25, 1998 (GB) ..... 9813777
Apr. 30, 1999 (GB) ..... 9909891

(51) Int. Cl.[7] ..... B24B 5/00

(52) U.S. Cl. ..... 451/5; 451/242; 451/49; 451/62; 451/178

(58) Field of Search ..... 451/5, 49, 62, 451/178, 242

(56) References Cited

U.S. PATENT DOCUMENTS 2,744,366 A 5/1956 Art ..... 51/238
3,503,156 A * 3/1970 Schaller ..... 451/242
4,346,535 A 8/1982 Asano et al. ..... 51/101 R
6,306,018 B1 * 10/2001 Coverdale et al. ..... 451/177
6,309,286 B1 * 10/2001 Laycock ..... 451/242

FOREIGN PATENT DOCUMENTS

| | | |
|---|---|---|
| EP | 0 799 676 A1 | 1/1997 |
| GB | 2 317 842 A | 8/1998 |
| WO | WO 95/11110 | 4/1995 |
| WO | WO 98/58767 | 12/1998 |

* cited by examiner

*Primary Examiner*—Timothy V. Eley
*Assistant Examiner*—Alvin J Grant
(74) *Attorney, Agent, or Firm*—Lee, Mann, Smith, McWilliams, Sweeney & Ohlson

(57) ABSTRACT

A grinding machine has a wheelhead movable tinder computer control perpendicular to the axis of a composite workpiece, mounted between a headstock and a tailstock, and workrests slidable along front and rear rails. Between the workrests are sandwiched rigid cover-spacers to protect the rails and prevent lateral movement of the workrests. A spring-operated thrust bar may be supported against a fixed dressing wheelhead to clamp the stack of cover-spacers and workrests together, in order to accurately locate and space apart the workrests.

46 Claims, 10 Drawing Sheets

APPARATUS AND METHOD FOR GRINDING COMPOSITE WORKPIECES

FIELD OF THE INVENTION

This invention concerns methods and apparatus for grinding workpieces which are composed of concentric in-line cylindrical regions and intermediate non-axial non-circular or eccentric regions. Examples of such workpieces are camshafts and crankshafts of internal combustion engines and such workpieces are referred to herein as composite workpieces.

BACKGROUND OF THE INVENTION

Because of the different techniques used for grinding in-line and off-axis regions of workpieces, it has hitherto been commonplace to grind the cylindrical region of a composite workpiece on one grinding machine and to transfer the workpiece to another grinding machine for grinding the non-axial regions such as cam lobes or crankpins.

With the trend towards lightweight engine components, camshafts and crankshafts have become less stiff and more prone to distortion as a result of grinding forces exerted on the workpiece by the grinding wheel particularly when high metal removal rates are desired. To this end it has been proposed to resist grinding forces exerted by the grinding wheel by means of so-called worksteadies or workrests which engage diametrically opposite regions of the workpiece without inhibiting rotation, to resist the bending moment created by the grinding wheel forces exerted on the workpiece.

In general the workrests have been applied against the journal bearing regions of the workpieces, i.e., the cylindrical co-axial regions of the workpiece which are normally intermediate non-circular or off-axis components, such as the cam lobes and crankpins of the exemplary workpieces.

It is an object of the present invention to provide a single machine for grinding composite workpieces.

It is a further object of the invention to improve the rigidity of the mounting for a workrest as incorporated in such a machine.

SUMMARY OF THE INVENTION

According to one aspect of the present invention in a grinding machine comprising a stationary support structure, a wheelhead assembly slidable relative to the said structure in a direction perpendicular to a workpiece axis, headstock and footstock means mounted on the structure and defining the workpiece axis, rotating a workpiece mounted therebetween, at least one workrest slidably adjustable along at least one rigid elongate member or rail which extends generally parallel to the workpiece axis, and programmable computer based control means for controlling the movement of the wheelhead, the rotation of the workpiece, and engagement and disengagement of the workrest with a cylindrical region of the workpiece, wherein means is provided for fixing the workrest at a specific axial location along the length of the said elongate rail so that the workrest aligns with a cylindrical region of the workpiece.

During grinding, swarf, coolant and grinding medium particles will be present in the environment around the interface between the grinding wheel and the workpiece, and in order to prevent any such material from reaching the sliding surface of the elongate rail on which the workrest slides, and for axially positioning the workrest along the rail, cover means is provided on opposite sides of the workrest to keep any such unwanted material away from the surface of the elongate support rail therebelow, and prevent lateral movement of the workrest from its selected position.

The workrest and the cover means preferably form a linear bearing with the rail.

Preferably the rail is made up of two spaced apart parallel rails.

According to a preferred feature of the invention, each of the covers forming the cover means is rigid and structural and either adjustable in length or available in different lengths to enable differently sized gaps measured parallel to the axis of the workpiece to be covered by the covers, depending on the desired position of the workrest.

The covers may be clamped in an axial sense so as to clamp between them the workrest and position the latter along the workpiece axis.

Where the sealing between the workrest and the cover means is insufficiently reliable to prevent the Penetration of fine particle material and fluid, telescoping covers may be provided below the rigid cover means which are sealed at least to the opposite sides of the workrest and either extend sufficiently far axially along the length of the elongate rail to prevent the ingress of unwanted particulate or fluid material, or are sealed at their opposite ends to end faces of support members between which the elongate rail extends, thereby forming a sealed enclosure within which the elongate rail is protected. The telescoping nature of the inner covers enables the workrest to be moved axially for adjusting its position along the rail relative to the workpiece.

The telescoping inner covers may be in the form of bellows which can extend or contract to accommodate axial movement of the workrest along the elongate rail.

The rigid covers are conveniently in the form of spacers and may be tubular so as to wholly encompass the elongate member, or C-shaped in cross-section to permit their insertion over and removal from the elongate rail as required.

Typically a plurality of cover spacers are provided which fit between, the workrest and appropriate. surfaces extending perpendicularly to the elongate workrest support rail, so that when fitted between the said surfaces and the workrest, the latter is held rigidly and fixedly at a single axial position along the support rail and therefore in axial fixed relationship to the workpiece axis, so that the workrest will always align with a similar region of each workpiece which is mounted between the headstock and tailstock centres on the said workpiece axis.

Typically the alignment is such as to correspond with a cylindrical region of the workpiece near the mid-position of the length of the workpiece measured between the two centres.

The invention is not limited to a single workrest but envisages the mounting of two or more workrests along the said elongate support rail for positioning against other cylindrical regions of a composite workpiece as aforesaid, such that as the said other cylindrical regions are ground they can be engaged by a workrest to resist sideways deformation of the workpiece as the grinding wheel is forced against diametrically opposite regions of the workpiece to grind the particular regions thereof.

Where a composite workpiece includes for example three spaced apart cylindrical regions which are to form the inner surfaces of journal bearings, three workrests are typically provided and in this event four rigid covers are provided each of an axial extent sufficient to just space the two outer workrests accurately relative to the central workrest, and the two outer workrests from fixed end faces at opposite ends of the elongate support rail on which the workrests slide.

Alternatively three such rigid covers may be provided for spacing the first of the workrests accurately relative to the headstock end of the workpiece, the second workrest relative to the said first workrest, and the third workrest relative to the second middle workrest, and clamping means is provided to retain the third workrest axially in position along the elongate rail and to maintain the assembly of spacing covers and workrests between a face of the headstock (or a fixture at the headstock end of the elongate rail), and the said clamping means.

In addition or alternatively to the spacing achieved by means of the said rigid covers, the workrests may include clamping means, grub screws, wing nuts or other devices for securing each workrest at a desired position along the length of the elongate rail. However the spacing achieved by individual accurately machined spacers each forming a cover for providing at least partial protection for the elongate rail, may be preferred, since this does not involve the need for individual clamping or tightening mechanisms which could damage the surface of the rail.

Preferably axial force is applied to the horizontal stack of workrest(s) and spacers by means of a thrust member acting through the tailstock so as to clamp the stack against a face of the headstock assembly, or a structure associated with or forming part of the headstock assembly.

In a method of setting up a grinding machine as aforesaid, the workpiece may be replaced by a setting up bar having cylindrical (journal bearing) regions machined therealong corresponding to diameter and axial extent and axial positions to the cylindrical (journal bearing) region of the workpiece to be ground, and the workrests are positioned both axially and radially so as to be appropriately positioned for engaging similar workpieces as they are loaded successively onto the machine.

The thrust member may be in two parts separable by an actuator, one part acting on the end of the stack through the tailstock, and the other engaging a fixed structure such as a dressing wheelhead assembly mounted on the machine bed. Spring means may be incorporated in the thrust member.

Each workrest preferably comprises a housing which is slidable along the elongate support rail and clamped in position axially, and jaws which can be advanced and retracted relative to the housing to engage a region of a workpiece. The jaws may be driven in and out by electrical or pneumatic or hydraulic drive means.

Where the workpiece is to be in axial compression independently of the axial compressive forces acting on the stack, a subsidiary housing containing the tailstock centre is slidable and adjustably mounted on the main tailstock showing which engage the said stack.

The invention is not limited to the grinding of one type of composite workpiece but can be applied to a grinding machine which under CNC control can move the wheelhead so as to either follow the eccentric throw of cam lobes of a camshaft, or the circular rotation of crankpins about the central axis of a crankshaft, so as to permit the grinding of the journal bearing regions as well as the cam lobes or crankpins of camshafts and crankshafts.

In accordance with another aspect of the invention, in a method of grinding a composite workpiece on a grinding machine as aforesaid, cylindrical journal bearing regions of the workpiece are first of all ground and after at least the first said cylindrical region has been finish ground, a workrest is engaged therewith, positioned as appropriate along the length of the workpiece axis, and after the cylindrical regions of the composite workpiece have all been ground, the wheelhead control is altered, and each of the non-cylindrical regions of the workpiece are ground in turn, the workrest remaining in position against the first to be ground of the cylindrical regions of the workpiece during all of the subsequent grinding operations of the workpiece.

Where the required stiffness can only be achieved by the use of two or more workrests, an appropriate number of such workrests are provided, and the control system is arranged to move each of the workrests into engagement with cylindrical regions of the workpiece after each said region is finish ground.

Since the first cylindrical region of the workpiece has to be ground without a workrest to resist the grinding forces, the first grinding step is preferably performed at a lower material removal rate and with reduced speed of advance of the grinding wheel so as to reduce the grinding forces exerted on the workpiece while the unsupported cylindrical region is ground. According to a preferred feature of the method, after an initial grind of the first cylindrical region, the workrest is introduced against that region which is still to be finished and the workrest is kept in position for the remainder of the grinding of the first said region.

Other workrests can be introduced and engaged against other cylindrical regions as they are ground in a similar way.

Once the workpiece has become supported by at least one workrest, grinding speeds and material removal rates can be increased within the limitations of the machine and grinding medium, so that the overall grinding time of the composite workpiece can be optimised. In particular the grinding of the non-circular or off-axis regions of cam lobes of camshafts and crankpins of crankshafts can be significantly increased in view of the presence of the workrests, so that the finish grinding of the non-circular and off-axis regions of a composite workpiece can be very much quicker than would otherwise be the case. This advantage, coupled with the saving in time which is realised by not having to demount a workpiece and remount it on a new machine, means that the overall machining time for a composite workpiece is significantly reduced.

Where the workpieces are either hollow or have hollowed ends, the headstock and tailstock centres may be in the form of conical workpiece-engaging devices, and where drive is to be transmitted to the workpiece this can be effected either by means of a positive link such as a key, or chuck, or peg drive where a peg enters an off-axis hole provided in the end surface of the workpiece.

However according to a preferred feature of the invention, where the workpiece does not have sufficient material in the end face which is to be driven to provide notches or apertures or openings for receiving pegs or other such driving devices a method of driving the workpiece involves providing an axial compressive force between headstock, workpiece and tailstock, and providing a good friction fit between a driven centre typically at the headstock and the hollow end of the workpiece engaged hereon. Drive can be transmitted to the workpiece with sufficient precision and lack of slip as to allow not only the cylindrical workpiece regions to be ground but also the circular and even off-axis regions to be ground, where the driving torque required to maintain rotation of the workpiece particularly during high metal removal rates, can be quite considerable.

According to a preferred aspect of this last feature of the invention the surface of the driving cone is preferably impregnated with diamond grit so as to provide a very hard but precision surface for engaging in a central circular opening in the end of a composite workpiece as aforesaid, and the axial compressive force exerted between the workpiece and the centres at the opposite ends of the workpiece, is sufficient to cause the grit to bite into the end surface of the workpiece material and accurately centre, and resist any relative movement between, the workpiece and the conical driving cone.

Since accurate circular indexing of a composite workpiece is needed to allow the CNC control of the wheelhead to enable non-circular and off-axis regions to be accurately ground, the workpiece must either incorporate an index mark which can be detected by means of a suitable optical or other sensing device associated with the grinding machine, to provide an index signal to the programmable computer based control system, or a vee notch indexing device may be provided under the control of the computer based control system which after the cylindrical regions have been ground, is advanced so as to engage around one of the non-circular or off-axis components, and after centering the component relative to the notch, provides a zero position for a rotatable indexing device associated with the workpiece drive, to allow accurate indexing of the workpiece thereafter under computer control, to present first one and then another of the non-circular or off-axis regions for grinding.

Since the different cylindrical and non-circular or off-axis regions are located at different axial positions along the length of the workpiece, means is provided for indexing the wheelhead relative to the workpiece or the workpiece relative to the wheelhead so as to enable the grinding wheel to address different regions of the workpiece as required.

Whilst the arrangement of cover means or spacers serves to accurately and firmly locate the workrests relative to the workpiece, there may occur a lack of rigidity in a plane perpendicular to the elongate rails, i.e., in the form of sway of the workrests. Also crabbing movement along the rails can result in misalignment of the workrests relative to the axis of rotation of the workpiece.

According to a further aspect of the present invention, such undesirable movement of the workrests relative to the rail can be obviated by providing for a clamping engagement between the workrest and one of the rails, the clamping being effected after the workrest has been slid into position along the rails, to retain the workrest in that position during the machining operation.

Where one of the two rails underlies the,jaws at the front of the workrest and the other rail, underlies the rear of the workrest, the clamp preferably engages the rail.

Preferably a first bearing assembly is provided below the front of the workrest for running on the front rail.

Undesirable crabbing of the carriage relative to the front rail can be avoided by incorporating roller bearings in the said first bearing assembly.

Preferably the cross-section of each of the rails is in the form of an I-beam, and the first bearing assembly located below the workpiece engaging jaws is adapted to engage opposite sides of the rail.

Preferably the shoulders of the upper and lower enlarged regions of the rail taper towards the narrow stem of the rail and the first bearing assembly includes rolling elements which are set at angles to complement the trapezoidal shape on each side of the rail.

In the case of the rear rail, a second bearing arrangement is provided which is adapted to engage one side of the rear rail and a moveable member is adjustably secured to the carriage for engaging the opposite side of the rear rail, and means is provided for tightening the movable member against the rear rail to clamp the rail between the fixed and movable members.

Preferably a clearance is provided between the rail which is to be clamped and the various surfaces of the second bearing arrangement to permit free travel when the clamping member has been disengaged from the rail and is in its unclamped condition. The sliding movement of the workrest is therefore governed by the engagement between the first bearing assembly and the front rail, and preferably a low friction engagement is ensured with lubrication as appropriate.

Preferably pre-loaded rolling bearings providing high stiffness are utilised.

The bearings may be double-sealed and/or axial sealed.

Conveniently the bearings on the rails are double wiped.

A preferred bearing assembly comprises the IKO LRXDC35.

A preferred rail comprises an IKO linear stainless steel rail.

Preferably a bearing seal assembly is provided around each bearing assembly and rail associated therewith, to prevent the ingress of dirt and/or mechanical particles.

The invention is not limited to the use of a single grinding wheel, but may be adapted to multiple grinding wheels enabling two or more regions of the workpiece to be ground simultaneously.

BRIEF DESCRIPTION OF THE DRAWINGS

The invention will now be described by way of example with reference to the accompanying drawings in which.

DETAILED DESCRIPTION OF FIGURES

Figure 1:
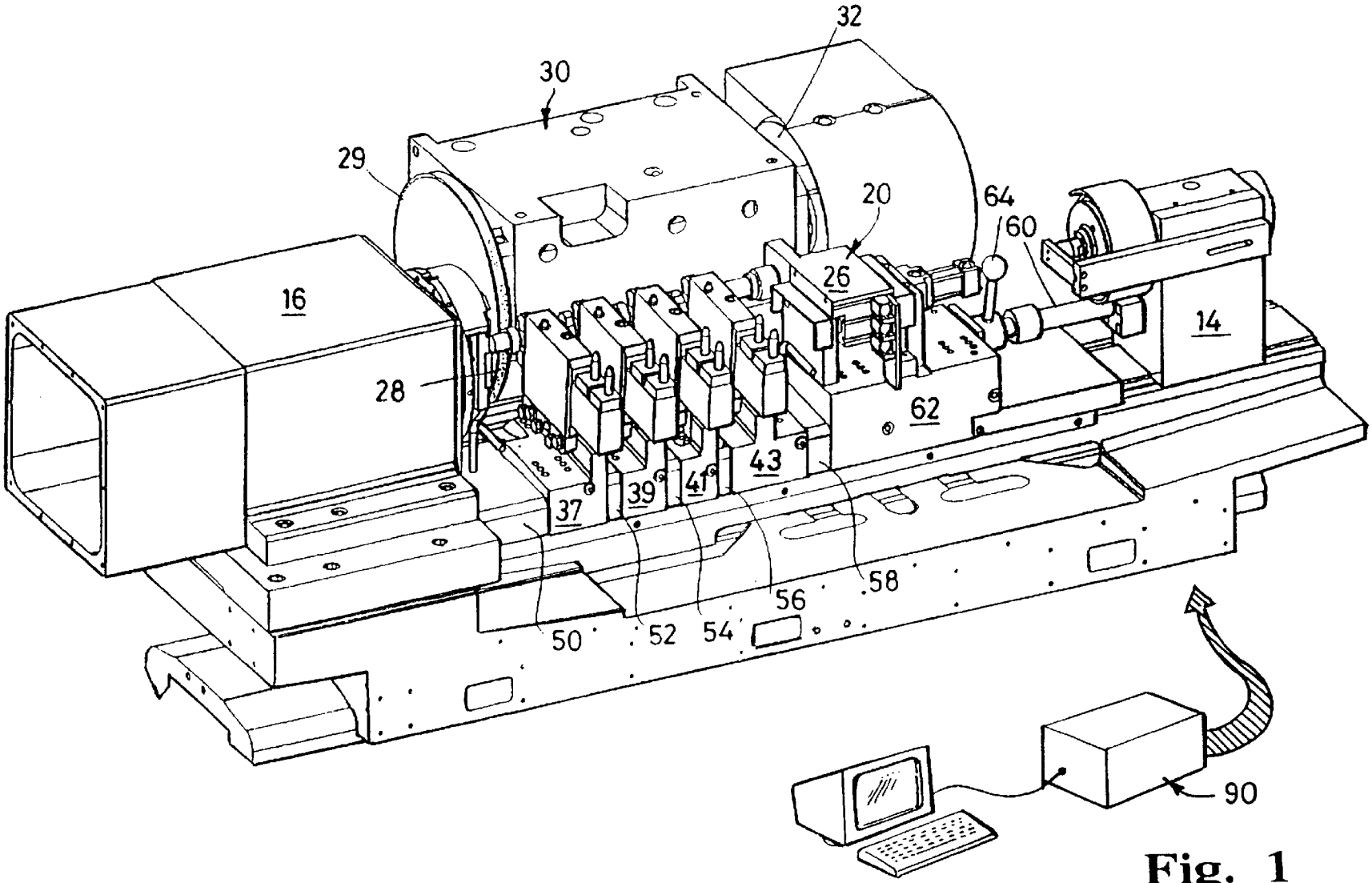
FIG. 1 is a perspective view of part of a grinding machine adapted to provide workpiece support during grinding a composite workpiece such as a crankshaft or camshaft of an internal combustion engine.
Figure 2:
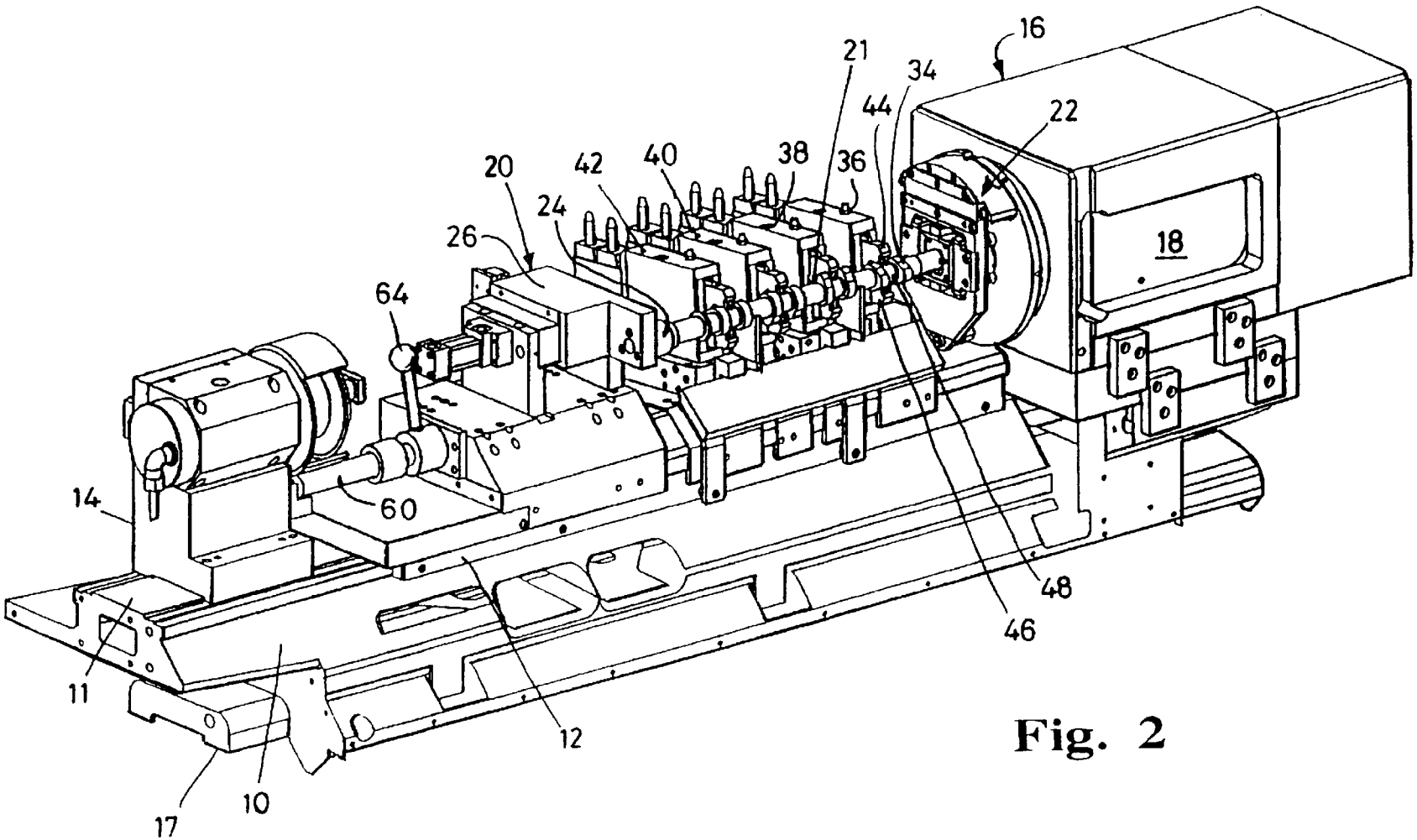
FIG. 2 is a similar view from the opposite side of the machine of FIG. 1 with the wheelhead removed.

In FIGS. 1 and 2 a fixed base 10 provides a slideway 11 on which a workslide 12 and dressing wheelhead 14 are slidable and securable in position. A headstock assembly 16 is mounted at one end of the base 10 and the latter is carried by a sub-base 17.

An electric motor 18 is housed within the headstock assembly casing 16.

A tailstock assembly generally designated 20 is mounted on a workslide 12 and a camshaft workpiece 21 is carried between a driving chuck generally designated 22 at the headstock end and in a chuck 24 carried by an upper section 26 of the tailstock assembly 20.

A grinding wheel 28 protected by a cover 29 is carried by a wheelhead assembly 30 to which is mounted an electric motor 32 for driving the wheelspindle and grinding wheel in rotation.

Although not shown, the wheelhead 30 is slidable along a slideway which extends perpendicularly to the workpiece axis and a further drive, either a feed screw or a linear motor (not shown) serves to advance and retract the wheelhead under computer control to allow the wheel to be brought into grinding engagement with the workpiece and to move in and out in synchronism with the rotation of non circular cam-lobe regions (such as 34 in FIG. 2) of the camshaft, in manner known per se.

In order to provide support for the camshaft during grinding, four workrests 36, 38, 40 and 42 are mounted between the headstock and tailstock assemblies, each comprising an Arobotech Workrest Unit Type 3520. As will be described in more detail with reference to later Figures, each of the workrests is mounted on a carriage 37, 39, 41 an 43, and each carriage is slidable on two parallel rails mounted on the upper face of the workslide 12. This allows the workrests to be adjusted in position along the length of the workslide 12.

Each workrest includes a pair of workpiece engaging jaws such as 44, 46 as denoted in relation to workrest 36. Sliding of the workrest carriage relative to the workslide enables the jaws 44, 46 to align with a cylindrical (journal bearing) region such as 48. As will be seen from FIG. 2, the other pairs of jaws engage the three other cylindrical journal bearing regions of the camshaft 21.

In order to accurately locate and space apart the workrest carriages 37–43, cover-spacers 50, 52, 54, 56 and 58 are sandwiched between the carriages and the opposed faces of the headstock and tailstock (see FIG. 1). Different spacings and registration of the workrests is achieved by slacking off the clamping force acting on the assembly of carriages and cover-spacers, removing some or all of the latter and replacing them with cover-spacers having a different width and reclamping the assembly.

Clamping is most simply achieved by providing a thrust bar 60, which may include a compression spring assembly, between the fixed dressing wheelhead body 14 and the rear face of the main housing 62 of the tailstock assembly 20, and providing an end face on the headstock (which like the dressing wheelhead body is fixed in position) against which the spacer 50 abuts. A lever 64 is pivotable to increase and decrease the thrust exerted on the clamped assembly. In use sufficient compressive force is exerted on the assembly of cover-spacers and workrests, to keep them fixed in position.

Figure 3:
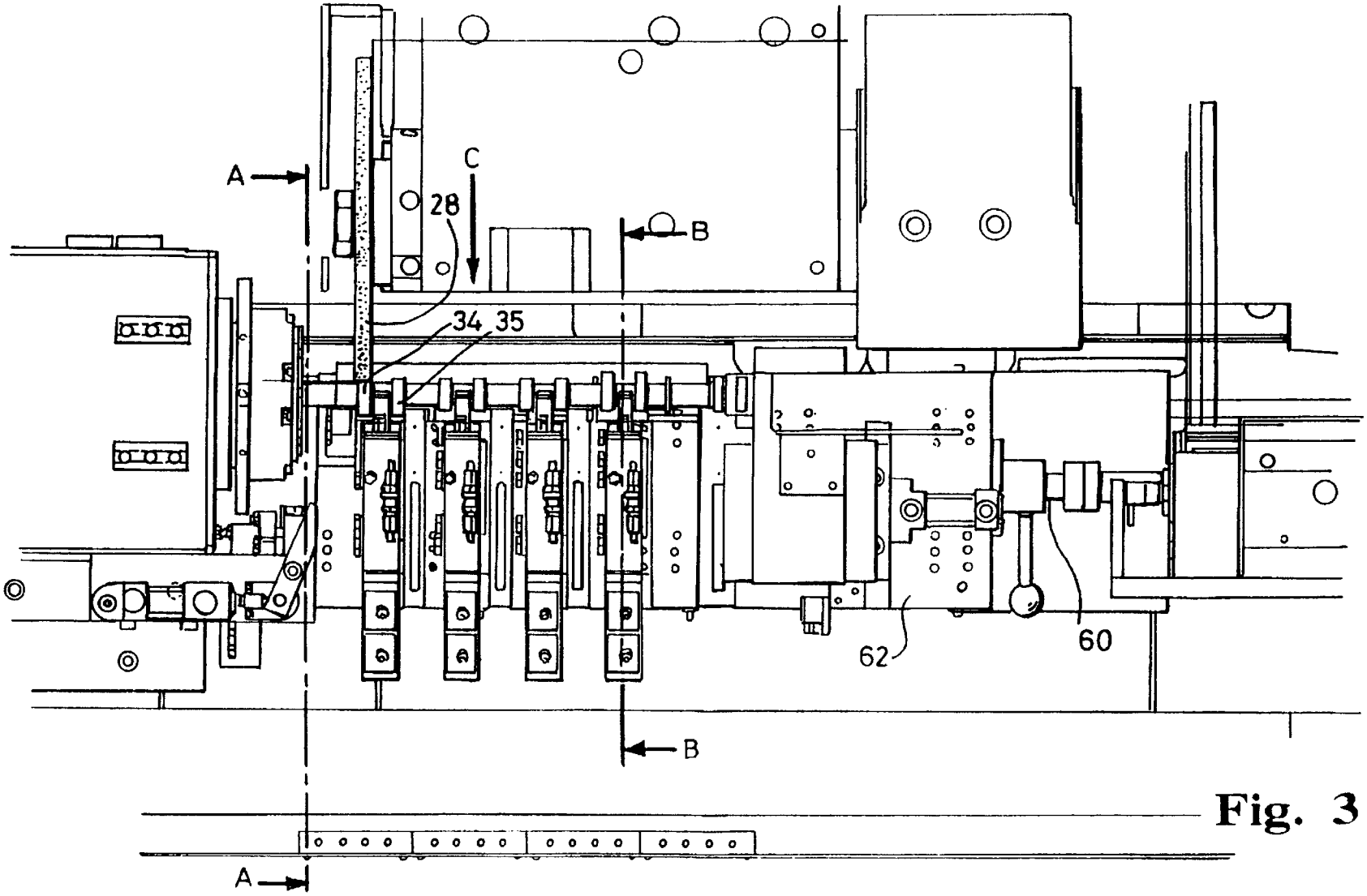
FIG. 3 is a plan view of the machine shown in FIG. 1.

The plan view of FIG. 3 shows how the thrust bar extends along an axis which is approximately midway of the workrest carriages so that when the compressive force acts on the main tailstock housing 62 there is little tendency to twist the housing 62. Twisting is further reduced by arranging that the carriages slide on two parallel spaced apart rails which are equidistant about the straight line continuation of the axis of the thrust bar 60.

FIG. 3 also shows how the jaws of the workrests engage the cylindrical regions of the camshaft and fit between the cam lobes 34, 35.

In FIG. 3 the grinding wheel 28 is shown grinding the cam lobe 34.

Figure 4:
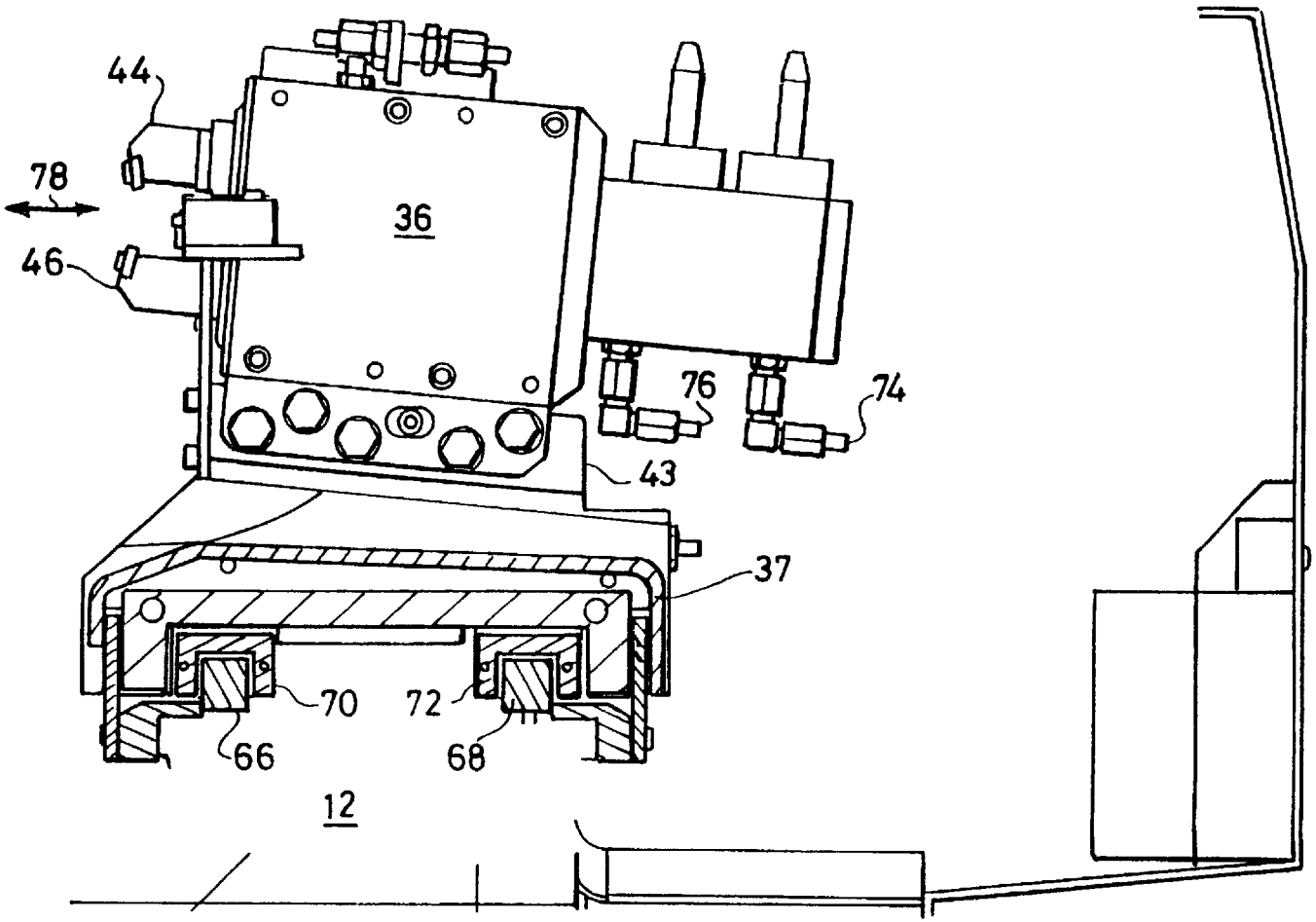
FIG. 4 is a cross-section on the line AA of FIG. 3.

The section on AA (FIG. 4) allows the two parallel spaced apart rails 66, 68 to be seen (in cross section) on which the workrest carriage 43 slides by means of linear bearings 70, 72. Also visible in cross-section is the end spacer 37. Fluid connections are shown at 74, 76 by which air or hydraulic fluid is conveyed to and from the workrest to drive the jaws 44, 46 in and out of the workrest housing, in the directions indicated by the arrow 78.

The section on BB (FIG. 5) shows the engagement of a cylindrical workpiece region 80 by the upper and lower jaws 82, 84 and an intermediate stop 86. The latter is that part of the workrest which provides the reaction to the grinding forces exerted by the grinding wheel on the workpiece. Each pair of jaws of each of the workrests includes a step such as 86 shown in FIG. 5.

Figure 6:
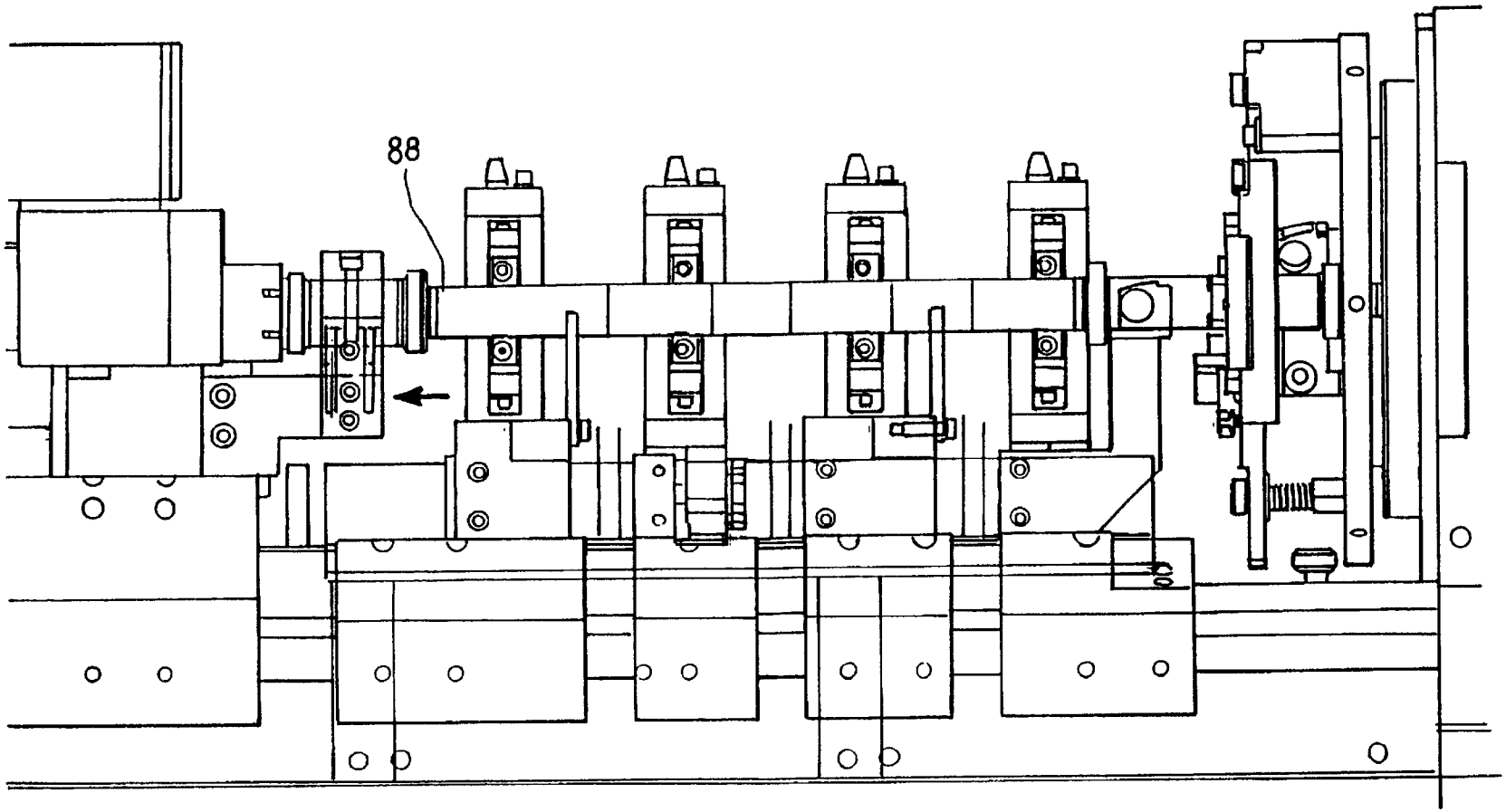
FIG. 6 is a rear view of part of the machine in the direction of arrow C in FIG. 3, with the workpiece replaced by a setting-up bar.

The rear view on arrow "C" in FIG. 3 and which comprises FIG. 6, shows how a machined setting up bar 88 can be fitted between headstock and tailstock preparatory co the replacement of a camshaft workpiece. This allows the workrest positions to be checked and the computer control system (item 90 in FIG. 1) to be initialised with position information relating to the workrest jaws, to allow the latter to be advanced as required during grinding to just the correct positions to engage similar cylindrical regions of a camshaft.

Figure 7:
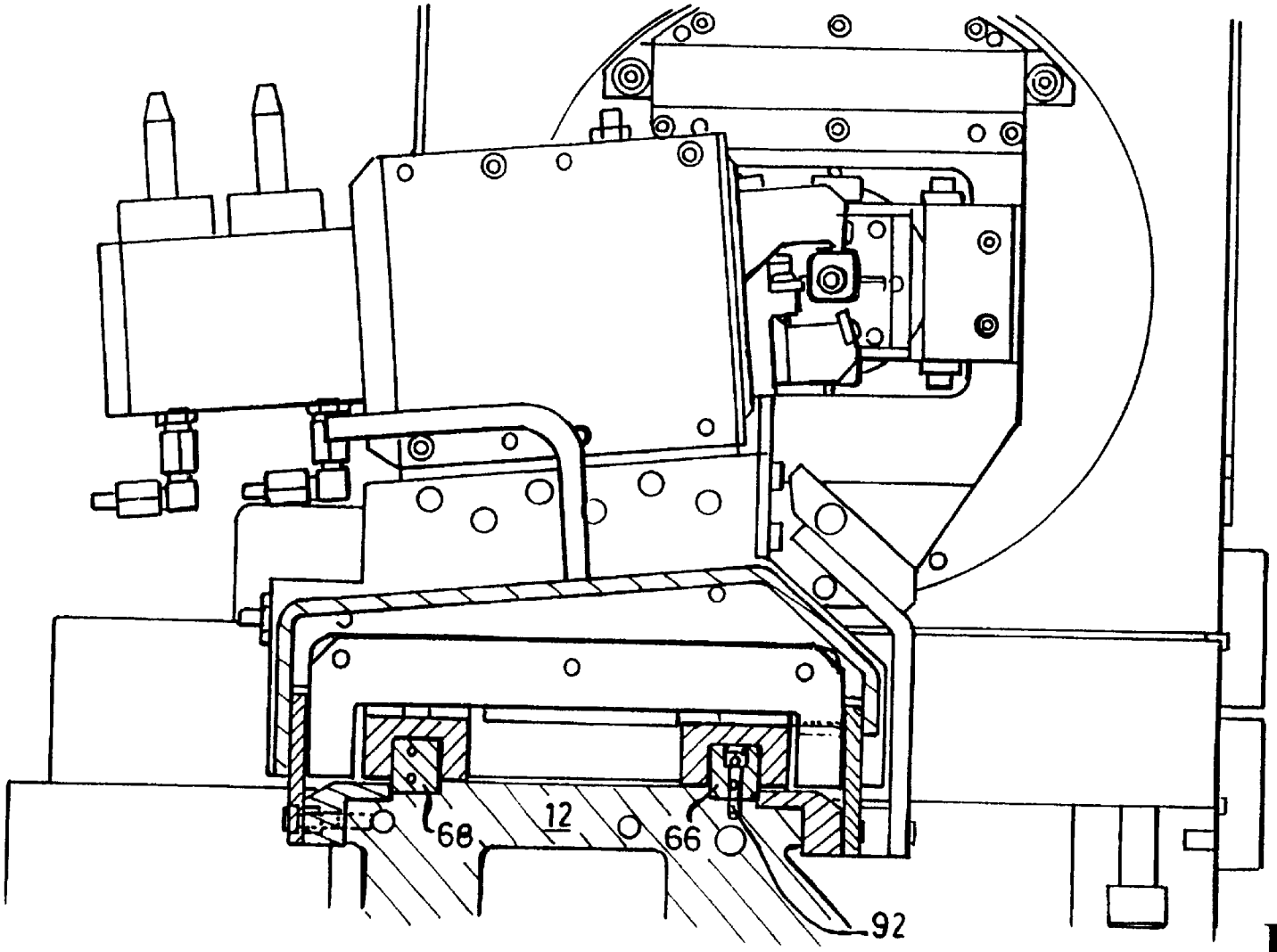
FIG. 7 is a cross-section looking towards the headstock showing a workrest, a spacer guard and a workrest carriage.

FIG. 7 shows how the rails 66, 68 are screwed to the workslide 12 as by screw 92.

Figure 8:
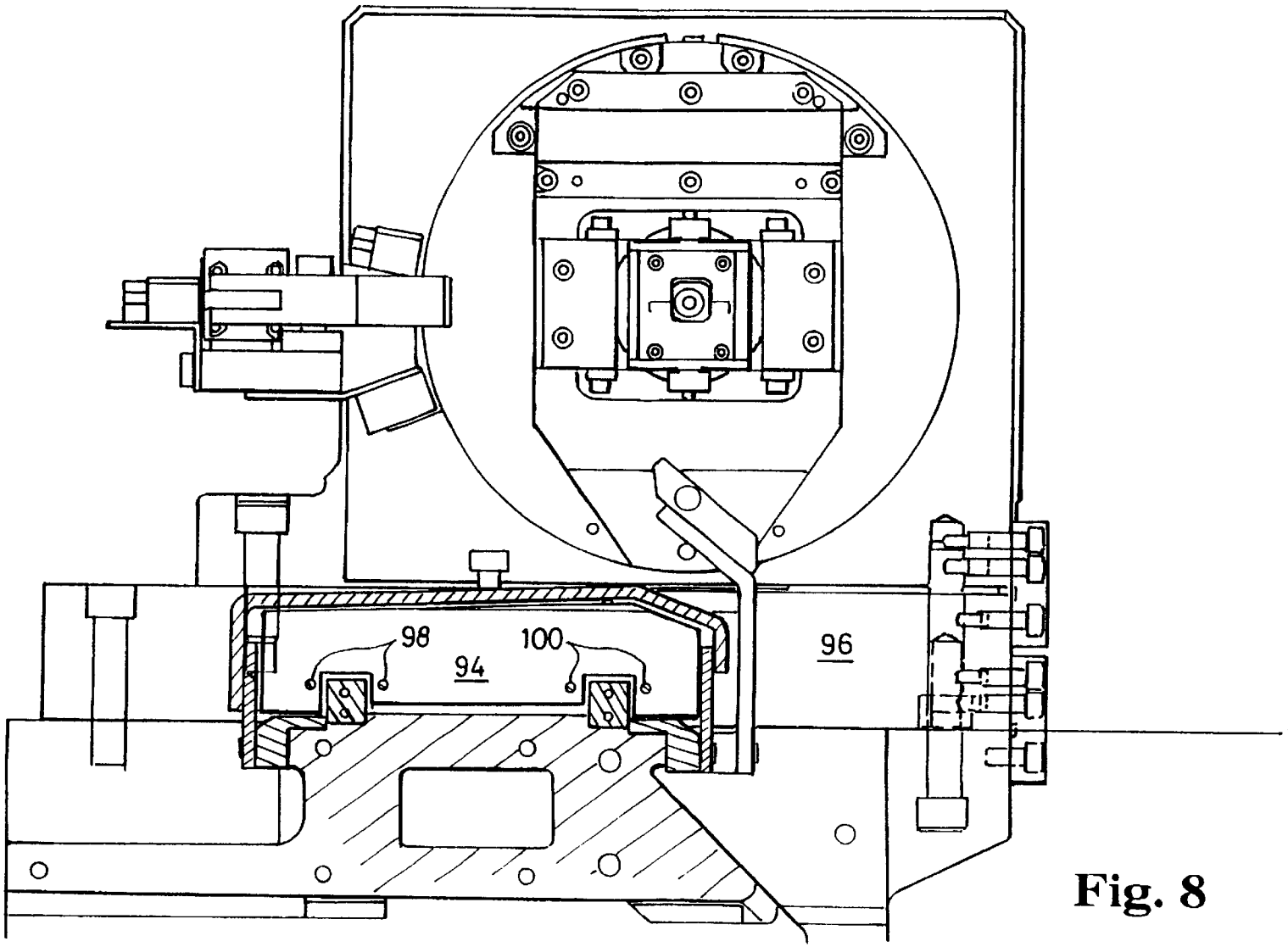
FIG. 8 is an end view of the headstock as viewed from the workpiece showing workpiece driver, first spacer guard and bellow end plate.

Below each of the cover-spacers, which serve to protect the rails and linear bearings associated therewith, are located bellows assemblies. Each assembly has a plate at each end for attachment to the opposed end faces of adjacent workrest carriages or the headstock or tailstock. One such bellows endplate is shown at 94 in FIG. 8. This is in fact an end plate of the bellows which fits between the end face of the headstock carriage 96 (also denoted in FIG. 2), and the opposed end face of the workrest carriage 37 (not shown in FIG. 8), below spacer 50. Pairs of screws or rivets designated 98 and 100, secure the bellows endplate to the headstock end face 96.

Figure 9:
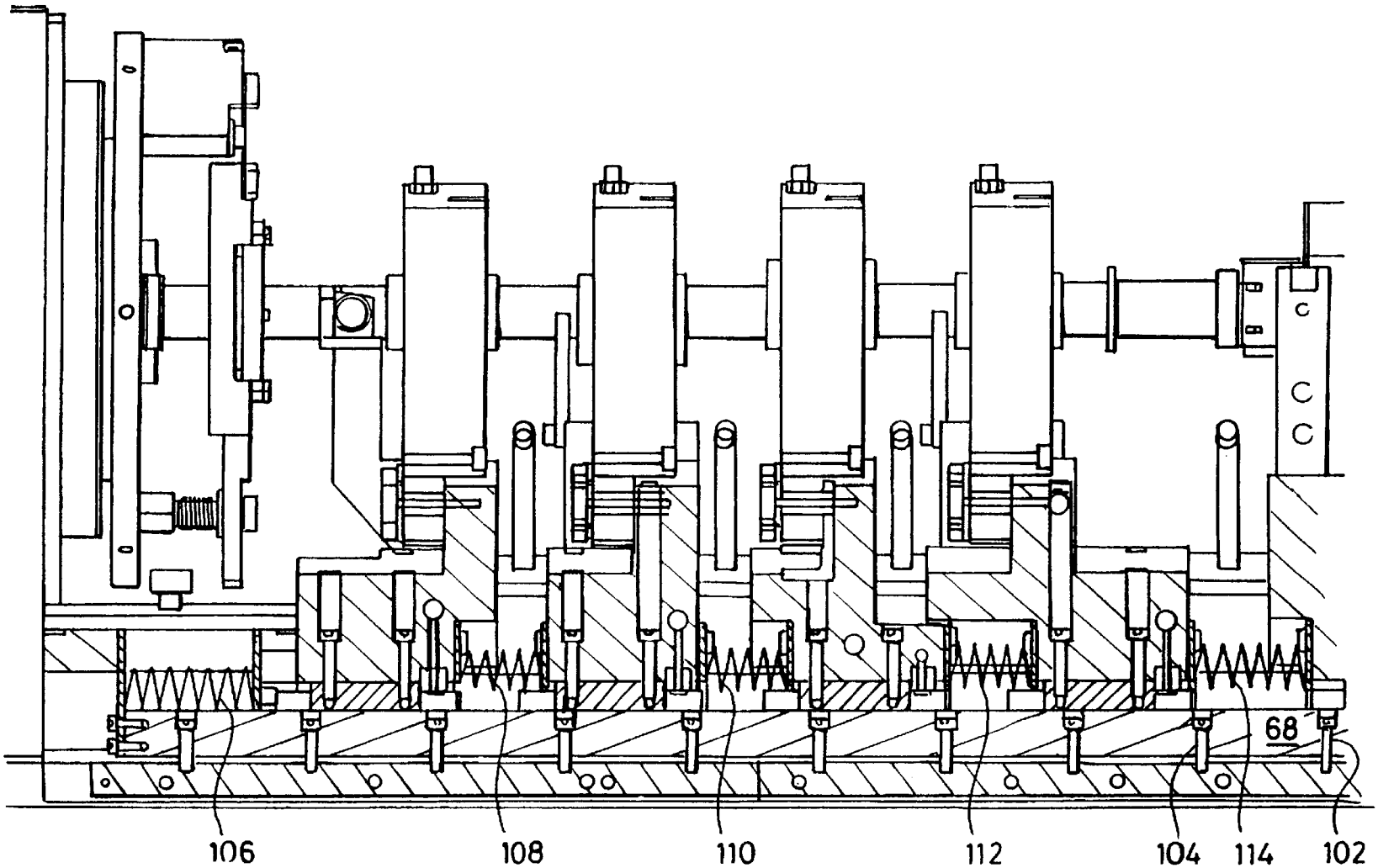
FIG. 9 is a section through the front rail on which the workrests slide, to a reduced scale.

FIG. 9 is an enlarged scale section through the front rail 68 shown secured in place by a plurality of screws 102, 104 etc. The bellows described with reference to FIG. 8 can here be seen at 106, 108, 110, 112 and 114.

The bellows assemblies further seal the sliding surfaces of the rails and linear bearings against swarf and other grinding media.

The cover-spacers may be sealed longitudinally to surfaces of the rail supporting structure as well as being sealed against the end faces of the workrests (or workrest carriages) and the headstock and tailstock housings.

Figure 5:
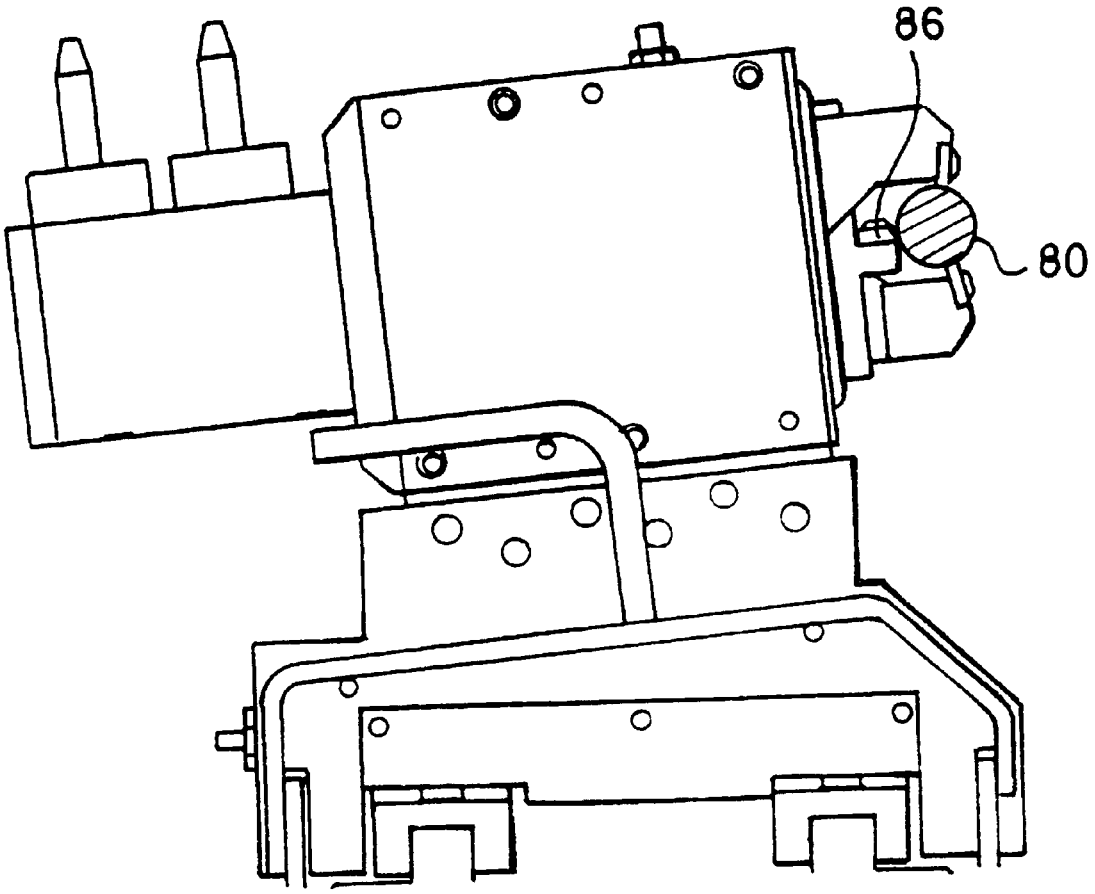
FIG. 5 is a cross-section on the line BB of FIG. 3.
Figure 10:
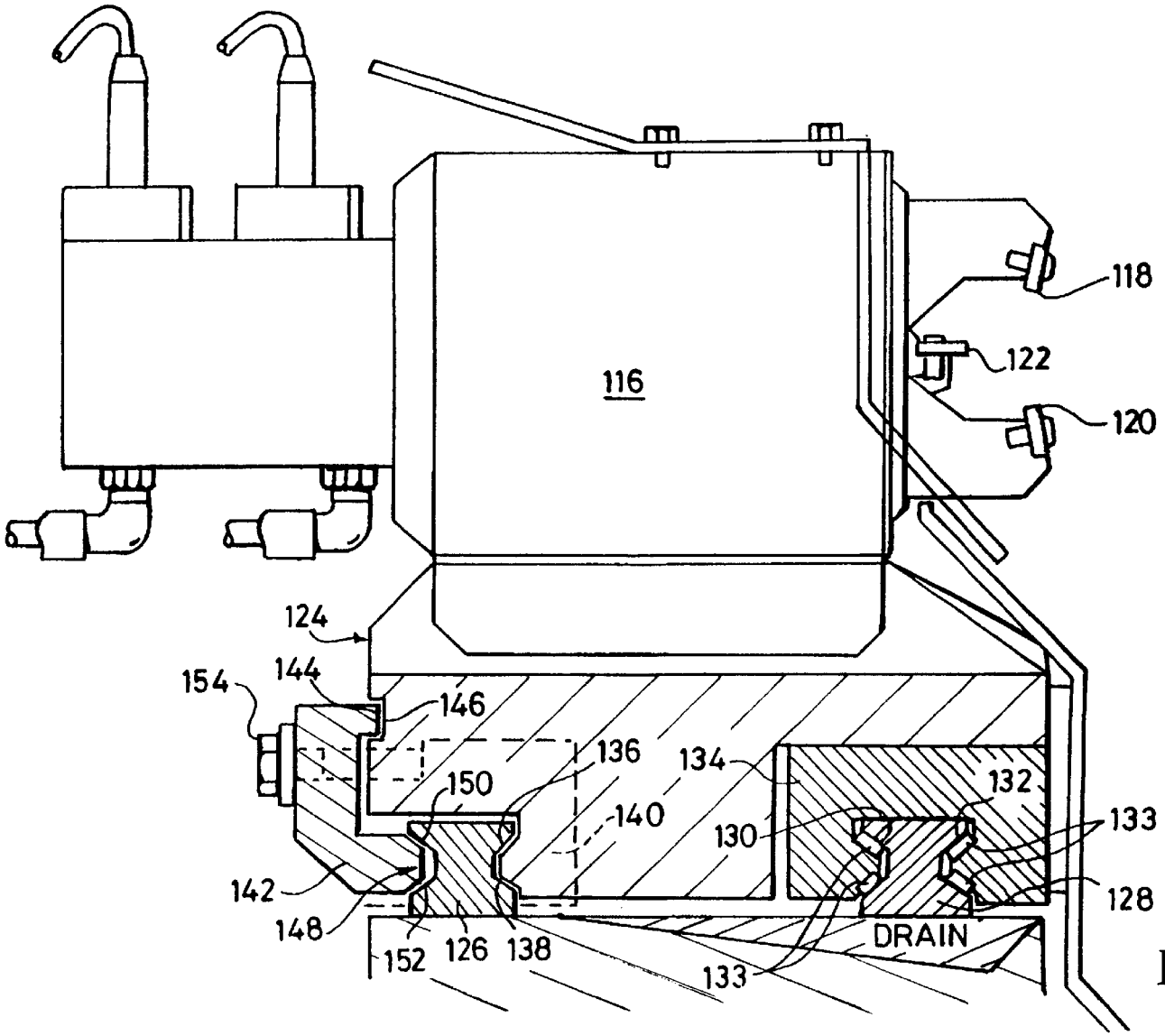
FIG. 10 is a cross-section to FIG. 5 showing a modified workrest mounting.

FIG. 10 is similar to FIG. 5, and shows a proprietary workrest 116 with work engaging jaws 118, 120 and 122, mounted on a carriage generally designated 124.

The carriage runs on two rails 126 and 128 the cross-section of each of which is similar to an I-beam and the enlarged upper and lower sections are joined by a narrow vertical stem and the shoulders of the upper and lower regions taper to the stem to provide linear inclined faces such as 130 and 132 in the case of rail 128.

Complementary inclined bearing surfaces are provided by four rows of cylindrical rollers 133 in a roller bearing assembly such as 134 secured to the underside of the carriage 124.

The inside faces 136, 138 of the other rail are similarly engaged by a slider generally designated 140, and its outer inclined faces are engaged by correspondingly inclined faces of a clamping member 142 of generally C cross-section, the upper end 144 of which is received in a parallel slided slot 146 for locating the member 142 relative to the carriage 124. The lower end generally designated 148 can be urged into engagement with the opposite inclined faces 150 and 152 of the rail 126 by screwing in a threaded bolt 154 the head of which forces the clamping device 142 into engagement at one end with the slot 146 and at its lower end with the inclined faces 150 and 152.

The act of tightening the bolt 154 thus jams the rail 126 between the slider 140 (itself attached to the underside of the carriage 124) and the lower end 148 of the C-shaped clamping device 142.

The clamping so effected not only restricts the tendency for the carriage 124 to slide along the rails 126 and 128, but also removes any tendency for the carriage 124 to rock about either of the rails.

The clamping action therefore restricts swaying or rocking of the carriage 124 relative to the rails, and particularly restricts rocking movement about the rail 128 in a plane perpendicular to the rails (i.e., within the plane of the sheet containing FIG. 10).

The slide 140 conventionally comprises one half of a roller bearing assembly similar to item 134 as provided for running on the front rail 128.

By providing for a roller bearing engagement with at least rail 128, such as by using an IKO roller bearing assembly type LRXDC35 made by Nippon Thompson Co. Ltd. of Tokyo 108, Japan, any tendency to crabbing movement of the carriage 124 relative to the rail 128 is largely eliminated.

What is claimed is:

1. A grinding machine comprising a stationary support structure, a wheelhead assembly carrying a grinding wheel being slidable relative to the said structure in a direction perpendicular to a workpiece axis, headstock and tailstock means mounted on the structure for rotating a composite workpiece mounted therebetween about said workpiece axis, a workrest slidably adjustable along a rigid elongate member therebelow and which extends substantially parallel to the workpiece axis, programmable computer-based control means for controlling the movement of the wheelhead, the rotation of the workpiece and the engagement and disengagement of the workrest with a cylindrical region of the workpiece, fixing means for fixing the workrest at a selected axial location along the length of the elongate member so that the workrest aligns with said cylindrical region of the workpiece, and cover means engageable with the workrest on opposite sides thereof to keep any unwanted material away from the surface of the elongate member therebelow and prevent lateral movement of the workrest from its selected location.

2. A machine according to claim 1 in which the elongate member is made up of two spaced apart parallel rails.

3. A machine according to claim 1 in which the workrest and the cover means form a linear bearing with the elongate member.

4. A machine according to claim 3 in which each of the cover means is rigid and either adjustable in length or available in different lengths to enable differently sized gaps measured parallel to the workpiece axis to be covered by the covers, depending on the selected location of the workrest.

5. A machine according to claim 4 in which the cover means are clamped axially so as to clamp between them, the workrest and also to locate the workrest along the workpiece axis.

6. A machine according to claim 4 and further comprising telescoping covers provided between the rigid cover means and the elongate member and which are sealed at respective ends to the opposite sides of the workrest and either extend axially along the length of the elongate rail to prevent the ingress of, unwanted particulate or fluid material, or are sealed at the ends opposite to end faces of support members between which the elongate rail extends, thereby forming a sealed enclosure within which the elongate rail is protected.

7. A machine according to claim 6 in which the telescoping covers are in the form of bellows which can extend or contract to accommodate axial movement of the workrest along the elongate member.

8. A machine according to claim 4 in which the rigid cover means are in the form of cover spacers and are either tubular so as to wholly encompass the elongate member, or C-shaped in cross-section to permit their insertion over and removal from the elongate member.

9. A machine according to claim 8 in which a plurality of cover spacers are provided which fit between the workrest and surfaces extending perpendicularly to the elongate member, so that when fitted between the said surfaces and the workrest, the latter is held rigidly and fixedly at a selected axial location along the elongate member and therefore in axial fixed relationship to the workpiece axis, so that the workrest will always align with a similar region of each workpiece which is mounted between the centres of the headstock and tailstock means.

10. A machine according to claim 9 in which the alignment is such as to correspond with a cylindrical region of the workpiece near the mid-position of the length of the workpiece measured between the two centres.

11. A machine according to claim 4 comprising a plurality of further workrests mounted along the elongate member for positioning against other cylindrical regions of a composite workpiece, such that as the other cylindrical regions are ground they can be engaged by a workrest to resist sideways deformation of the workpiece as the grinding wheel is forced against a region of the workpiece which is diametrically opposite one of the further workrests to grind the particular regions thereof.

12. A machine according to claim 11 in which the composite workpiece includes three spaced apart cylindrical regions which are to form the inner surfaces of journal bearings, wherein three workrests and four rigid covers means are provided, the cover means extending sufficiently to just space the two outer workrests accurately relative to the central workrest, and the two outer workrests from fixed end faces at opposite ends of the elongate member on which the workrests slide.

13. A machine according to claim 12, in which three rigid covers means are provided for spacing the first of the workrests accurately relative to the headstock end of the workpiece, the second workrest relative to the said first workrest, and the third workrest relative to the second middle workrest, and clamping means is provided to retain the third workrest axially in position along the elongate rail and to maintain the assembly of cover means and workrests between a face of the headstock or a fixture at the headstock end of the elongate member and the said clamping means.

14. A machine according to claim 11 in which the workrests include clamping devices, for securing each workrest at a selected location along the length of the elongate member.

15. A machine according to claim 1 in which the cover means and workrest (s) form a horizontal stack, and an axial force is applied to the horizontal stack by means of a thrust member acting through the tailstock so as to clamp the stack against a face of the headstock or a structure associated with or forming part of the headstock.

16. A machine according to claim 15 in which spring means is incorporated in the thrust member.

17. A machine according to claim 1 in which the workrest comprises a housing which is slidable along the elongate member and clampable in position, and jaws which can be advanced and retracted relative to the housing to engage a region of a workpiece.

18. A machine according to claim 17 in which the jaws are driven in and out by electrical or pneumatic or hydraulic drive means.

19. A machine according to claim 15 in which the workpiece is adapted to be in axial compression independently of the axial compressive forces acting on the horizontal stack, and a subsidiary housing containing the tailstock centre is slidably and adjustably mounted on the main tailstock which engages the stack.

20. A machine according to claim 15 in which the thrust member is in two parts separable by an actuator, one part acting on the end of the stack through the tailstock, and the other engaging a fixed structure mounted on the machine.

21. A machine according to claim 17 as dependent on claim 3, in which clamping means is engageable between the workrest and one of the rails, the clamping means being effected after the workrest has been slid into a selected location along the rails, to retain the workrest in that position during the machining operation.

22. A machine according to claim 21 in which a first one of the two elongate rails underlies the jaws of the workrest and a second rail underlies the other side of the workrest, with the clamping means engaging the second rail.

23. A machine according to claim 22 in which each rail is of trapezoidal section, the upper and lower enlarged regions of the rail tapering towards a narrow stem of the rail, and in which the first bearing assembly includes rolling elements which are set at angles to complement the trapezoidal shape on each side of the rail.

24. A machine according to claim 22 in which a second bearing assembly is provided to engage one side of the second rail, and a movable member is adjustably secured to the workrest for engaging the opposite side of the rear rail, and clamping means is provided for tightening the movable member against the rear rail to clamp the workrest to the rail.

25. A machine according to claim 24 in which a clearance is provided between the second rail which is to be clamped and the various surfaces of the second bearing assembly to permit free travel when the clamping means has been disengaged from the rail and is in its unclamped condition.

26. A machine according to claim 22 in which a first bearing assembly is provided below the jaws of the workrest for running on the first rail.

27. A machine according to claim 26 in which roller bearings are incorporated in the first bearing assembly.

28. A machine according to claim 26 in which the cross-section of each of the rails is in the form of an I-beam, and the first bearing assembly is adapted to engage opposite sides of the first rail.

29. A machine according to claim 26 in which at least the first bearing assembly comprises pre-loaded rolling bearings.

30. A machine according to claim 29 in which the bearings are double-sealed and/or axially sealed.

31. A machine according to claim 29 in which the bearings on the elongate rails are double wiped.

32. A machine according to claim 26 in which a the first bearing assembly comprises the IKO LRXDC-35.

33. A machine according to claim 26 in which a bearing seal assembly is provided around at least the first bearing assembly and the first rail associated therewith, to prevent the ingress of dirt or machined particles.

34. A machine according to claim 1 in which the elongate member comprises an IKO linear stainless steel rail.

35. A method of setting up a grinding machine as claimed in claim 1, in which the composite workpiece is replaced by a setting-up bar having at least one cylindrical region machined therealong corresponding in diameter, axial extent and axial position to the cylindrical region of the workpiece to be ground, and a workrest is positioned both radially and axially along said bar so as to be positioned for engaging similar workpieces as they are successively loaded onto the machine.

36. A method of grinding a composite workpiece on a grinding machine as claimed in claim 1, in which cylindrical regions of the workpiece are first to be ground, and after at least the first said cylindrical region has been finish ground, a workrest is engaged therewith, positioned along the length of the workpiece axis, and after the cylindrical regions of th e composite workpiece have all been ground, the wheelhead control is altered, and each non-cylindrical region of the workpiece is ground in turn the workrest remaining in position against the first to be ground of the cylindrical regions of the workpiece during all of the subsequent grinding operations of the workpiece.

37. A method according to claim 36, in which after an initial grinding of the first cylindrical region, the workrest is introduced against said first region which is still to be finished and the workrest is kept in position for the remainder of the grinding of said first region.

38. A method according to claim 37 in which other workrests are introduced and engaged against other cylindrical regions as they are ground in a similar way.

39. A machine according to claim 14 in which composite workpieces to be ground are either hollow or have hollowed ends, the headstock and tailstock centres are in the form of conical workpiece-engaging devices, and drive is transmitted to the workpiece by means of a positive link.

40. A machine according to claim 1, further comprising means for providing an axial compressive force between headstock, workpiece and tailstock, and a friction fit between a driven centre at the headstock and an end of the workpiece engaged thereon.

41. A method according to claim 36 in which the required stiffness of the workpiece is achieved by the use of two or more workrests, said programmable control means being arranged to move each of the workrests into engagement with cylindrical regions of the workpiece after each said region is finish ground.

42. A machine according to claim 1 in which said driven centre comprises a driving cone whose surface is impregnated with diamond grit for engaging in a central circular opening in said end of the workpiece, and in which the axial compressive force exerted between the workpiece and the centres at the opposite ends of the workpiece is sufficient to cause the grit to bite into the end surface of the workpiece material and to accurately center the workpiece, and resist any relative movement between, the workpiece and the driving cone.

43. A machine according to claim 39 in which the workpiece either incorporates an index mark which can be detected by means of a sensing device associated with the grinding machine, to provide an index signal to the programmable control means, or a vee notch indexing device is provided under the control of the programmable control means which, after the cylindrical regions have been ground, is advanced so as to engage around a non-cylindrical region of the workpiece, and after centering the component relative to the notch, provides a zero position for a rotatable indexing device associated with the workpiece drive, to allow accurate indexing of the workpiece thereafter under computer control, to present first one and then another of the non-cylindrical region for grinding.

44. A method according to claim 36 in which an initial grinding step is performed at a lower material removal rate, and with reduced speed of advance of the grinding wheel than in subsequent grinding steps, so as to reduce the grinding forces exerted on the workpiece while the unsupported cylindrical region is ground.

45. A machine according to claim 1 in which means is provided for indexing the wheelhead assembly relative to the workpiece or the workpiece relative to the wheelhead assembly, so as to enable the grinding wheel to address different regions of the workpiece as required.

46. A machine according to claim 1, further comprising multiple grinding wheels, enabling two or more regions of the workpiece to be ground simultaneously.

* * * * *